US006401313B1

(12) United States Patent
LeVey

(10) Patent No.: US 6,401,313 B1
(45) Date of Patent: Jun. 11, 2002

(54) BUCKLE

(75) Inventor: Kenneth LeVey, West Chicago, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/589,211

(22) Filed: Jun. 7, 2000

(51) Int. Cl.[7] ..... A44B 11/25; A44B 17/00

(52) U.S. Cl. ..... 24/629; 24/171; 24/194; 24/615; 24/664

(58) Field of Search ..... 24/629, 615, 616, 24/617, 171, 194, 625

(56) References Cited

U.S. PATENT DOCUMENTS 3,600,917 A * 8/1971 Krock ..... 24/629
4,559,679 A * 12/1985 Downey ..... 24/615
4,924,562 A * 5/1990 Pogharian ..... 24/664
6,003,213 A * 12/1999 Keller et al. ..... 24/615

FOREIGN PATENT DOCUMENTS

DE 2328370 * 6/1973 ..... 24/625

* cited by examiner

*Primary Examiner*—Victor Sakran
(74) *Attorney, Agent, or Firm*—Mark W. Croll; Donald J. Breh; Paul F. Donovan

(57) ABSTRACT

A buckle having a first latch member disposed in a body member passage from one end thereof, a second latch member with a latch cam disposed in the passage of the body member from an opposite end thereof, the first and second latch members are positionable in a latching configuration where the first and second latch members are engaged with each other, the first and second latch members are positionable in the passage of the body member in an unlatching configuration where the latch cam is engaged with the body cam and the first and second latch members are disengaged from each other.

18 Claims, 2 Drawing Sheets

BUCKLE

BACKGROUND OF THE INVENTION

The invention relates generally to buckles, and more particularly to buckles suitable for latching web end portions.

An object of the present invention is to provide in some embodiments thereof novel buckles that overcome problems in and improve upon the prior art.

Another object of the invention is to provide in some embodiments thereof novel buckles that are economical and reliable.

Another object of the invention is to provide in some embodiments thereof novel buckles having improved latching and retention performance.

A further object of the invention is to provide in some embodiments thereof novel buckles having improved load bearing capacity.

Another object of the invention is to provide in some embodiments thereof novel buckles having improved unlatching performance without adversely affecting load bearing capacity.

Still another object of the invention is to provide in some embodiments thereof novel buckles having fail-safe release performance.

Yet another object of the invention is to provide in some embodiments thereof novel buckles having a release force that is independent of buckle retention force.

Another object of the invention is to provide novel strap fastening buckles that remain buckled upon application of opposite tensile forces to first and second latch members disposed in a buckle body member, and a buckle that releases upon application of opposite tensile forces to the buckle body member and one of the first and second latch members.

A more particular object of the invention is to provide in some embodiments thereof novel buckles comprising a first latch member at least partially disposed in a passage of a body member from one end thereof, a second latch member at least partially disposed in the passage from another end thereof, the first and second latch members are movable to a latching position in the passage where the first and second latch members are engaged, and the first and second latch members are movable to an unlatching position in the passage where the first and second latch members are disengaged.

Another more particular object of the invention is to provide in some embodiments thereof novel buckles comprising a first latch member disposed in a body member passage from one end thereof and a second latch member disposed in the body member passage from an opposite end thereof, the first and second latch members are movable in the passage to a latching configuration where the first latch member is engageable with the second latch member, and the first and second latch members are movable in the passage to an unlatching configuration where a latch cam of the second latch member is engaged with a body cam in the passage and the second latch member is flexed away from the first latch member.

Yet another more particular object of the invention is to provide in some embodiments thereof novel buckles comprising a first engagement portion of a first latch member disposed in a passage of a body member from an opening on one end thereof and a second engagement portion of a second latch member disposed in the body member passage from an opening on an opposite end thereof, the first and second engagement portions are engageable with each other when the first and second latch members are in a first position in the body member passage, a latch cam of the second latch member is engaged with a body cam in the passage and the first and second engagement portions are disengaged from each other when the first and second latch members are moved to a second position in the body member passage.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
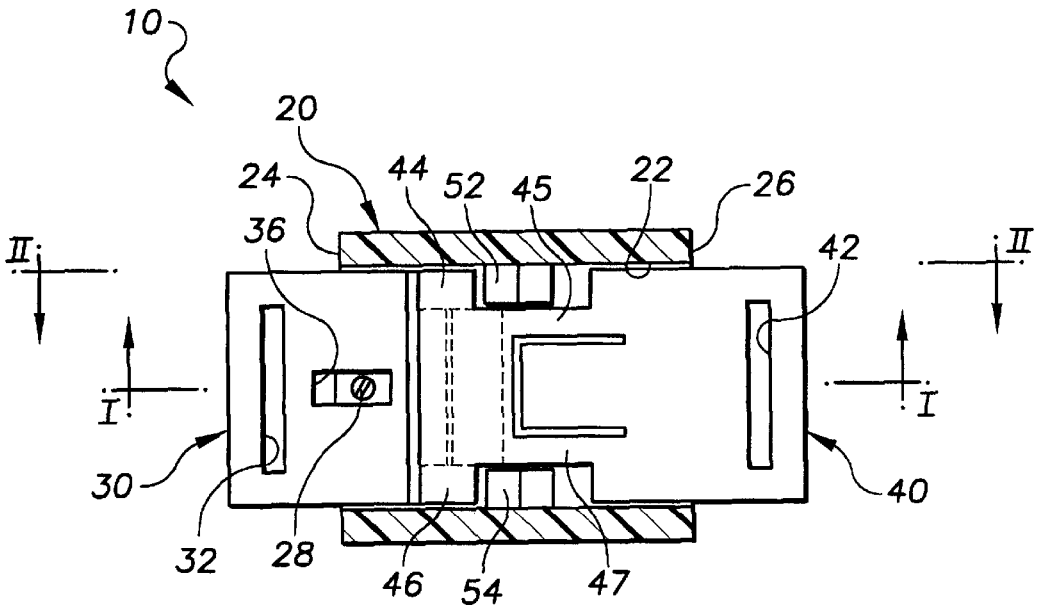
FIG. 1 is a partial top sectional view of a buckle in a latching configuration according to an exemplary embodiment of the invention.

In FIG. 1, the exemplary buckle 10 comprises generally a body member 20 having a passage 22 therethrough between first and second opposites ends 24 and 26 thereof A first latch member 30 is disposed at least partially in the passage of the body member from one end thereof, and a second latch member 40 is disposed at least partially in the passage of the body member from the opposite end thereof.

The first and second latch members may comprise corresponding strap engagement portions, for example slots 32 and 42 through which free strap or web end portions, not illustrated, are looped and fastened as is well known in the art. In other embodiments, one or both of the latch members may be configured for use without straps.

The first and second latch members 30 and 40 are generally movable in the body member passage to latching and unlatching positions, as discussed more fully below.

In the exemplary embodiment, a first engagement portion is disposed at least partially across one side of the first latch member, and a second engagement portion is disposed at least partially across a side of the second latch member opposite the side of the first latch member on which the first engagement portion is disposed.

Figure 4:
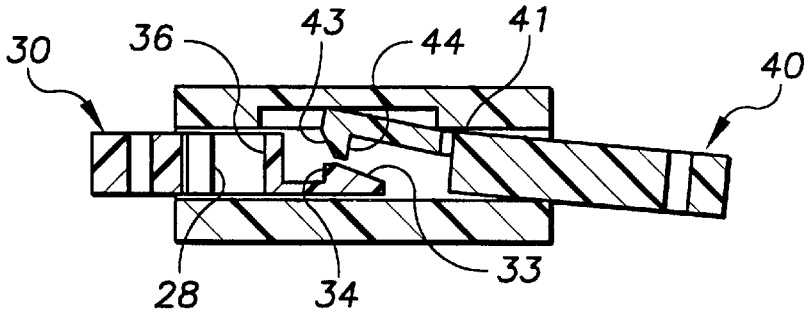
FIG. 4 is a partial sectional view of the exemplary buckle in an unlatching configuration.

As best illustrated in FIG. 4, the exemplary first engagement portion comprises a first edge 34 formed by a corresponding slot across the upper side of the first latch member, and the second engagement portion comprises a second edge 44 formed by a corresponding slot at least partially across the lower side of the second latch member. Alternatively, the first and second edges may be formed by protrusions on the corresponding latch members rather than the slots of the exemplary embodiment.

A body cam is disposed in the passage of the body member, and in the exemplary embodiment of FIG. 1 the body cam comprises discrete body cam members 52 and 54 protruding from opposite sides of the body member passage.

A latch cam is disposed on one of the first or second latch members, and in the exemplary embodiment of FIG. 1 the latch cam comprises discrete latch cam members 44 and 46 extending from corresponding resilient arms 45 and 47 of the second latch member 40.

Figure 2:
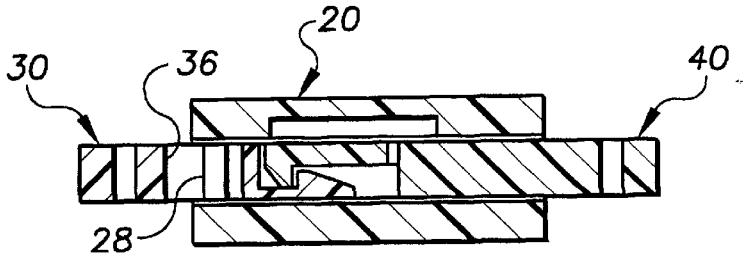
FIG. 2 is a partial sectional view along lines I—I of FIG. 1.
Figure 3:
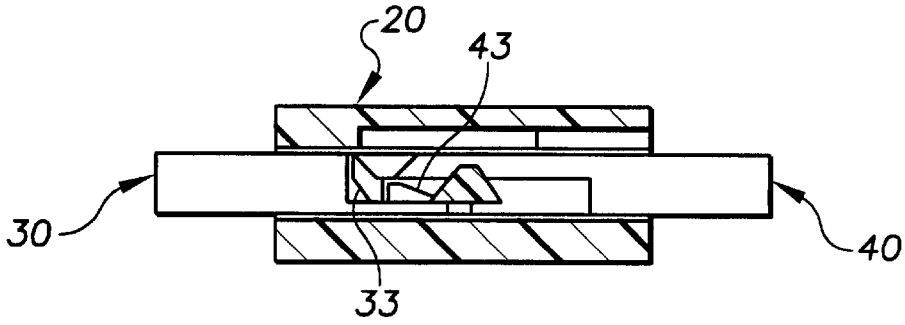
FIG. 3 is a partial sectional view along lines II—II of FIG. 1.

The first and second latch members are positionable in the passage of the body member in a latching position or configuration, illustrated in exemplary FIGS. 1–3, where the first engagement portion of the first latch member is engageable with the second engagement portion of the second latch member, thereby preventing separation of the first and second latch members 30 and 40 when opposite tensile forces are applied thereto.

Figure 5:
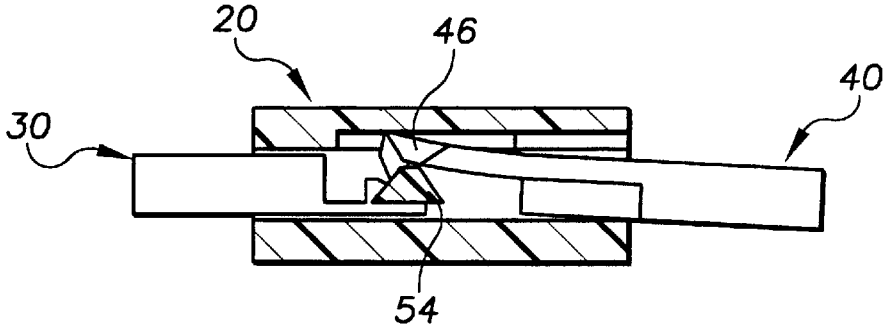
FIG. 5 is another partial sectional view of the exemplary buckle in the unlatching configuration.

The first and second latch members are also positionable in the passage of the body member in an unlatching configuration, illustrated in exemplary FIGS. 4 and 5, so that the first and second latch members may be released, or unlatched, whereby in some embodiments at least one of the first and second latch members may be withdrawn from the passage of the body member.

In exemplary FIG. 3, the first and second latch members 30 and 40 are movable in unison, in other words in the latched or latching configuration, in the passage of the body member upon applying opposite tensile forces to the body member 20 and to the second latch member 40 until the latch cam of the second latch member engages the body cam in the body member passage, thereby unlatching the first and second latch members.

In exemplary FIG. 5, when the discrete body cam members engage the discrete latch cam members (only body cam member 54 and latch cam member 46 are illustrated in FIG. 5) the second latch member and more particularly the second engagement portion thereof is flexed away from first engagement portion of the first latch member. Thus configured, the first and second latch members 30 and 40 are disengaged or released, and one or both of the latch members may be withdrawn from the body member 20.

In one embodiment, one of the latch members is coupled to the body member in the manner that permits sufficient movement thereof in the body member passage between the latching and unlatching configurations.

In the exemplary embodiment of FIGS. 1, 2 and 4, a retention member, for example a stud or pin 28, of the body member is disposed through a slot 36 of the first latch member 30 to couple the first latch member to the body member. The slot 36 permits movement of the first latch member between the latched configuration illustrated in FIGS. 1 and 2 and the unlatched configuration illustrated in FIGS. 4 and 5.

In FIGS. 3 and 4, the exemplary first and second latch members are latched by inserting the second latch member 40 into the body member passage whereupon the second engagement portion of the second latch member is flexed away from the first engagement portion of the first latch member by engagement between the body and latch cams and/or by engagement between beveled leading surfaces 33 and 43 of the latch members.

The first and second latch members and the body member including the body cams thereof are formed preferably of plastic materials, for example in molding operations.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A buckle comprising:

a body member having a passage extending between first and second opposite ends thereof;

a first latch member disposed at least partially in the passage of the body member from the first end thereof;

a second latch member disposed at least partially in the passage of the body member from the second end thereof, the first and second latch members movable to a latching position in the passage where the first and second latch members are engaged, and the first and second latch members being movable axially relative to the passage to an unlatching position in the passage where the first and second latch members are disengaged.

2. The buckle of claim 1, a body cam on the passage of the body member, a latch cam disposed on the second latch member, the latch cam engaged with the body cam when the first and second latch members are in the unlatching position.

3. The buckle of claim 2, the latch cam is disposed on a resilient arm of the second latch member.

4. The buckle of claim 1, the first latch member is fastened to the body member and is movable in the passage thereof between the latching and unlatching positions relative to the body cam.

5. A buckle comprising:

a body member having a passage extending between first and second opposite ends thereof, a first latch member disposed at least partially in the passage of the body member from the first end thereof, a second latch member disposed at least partially in the passage of the body member from the second end thereof, the first and second latch members movable to a latching position in the passage where the first and second latch members are engaged, the first and second latch members movable to an unlatching position in the passage where the first and second latch members are disengaged; and a first engagement portion on an upper side of the first latch member and a second engagement portion on the lower side of the second latch member, the first and second engagement portions are engaged in the latching position and disengaged in the unlatching position.

6. A buckle comprising:

a body member having a passage extending between first and second opposite ends thereof;

a first latch member disposed at least partially in the passage of the body member from the first end thereof;

a second latch member disposed at least partially in the passage of the body member from the second end thereof;

the first and second latch members movable to a latching position in the passage where the first and second latch members are engaged, the first and second latch members movable to an unlatching position in the passage where the first and second latch members are disengaged;

a body cam on the passage of the body member, a latch cam disposed on the second latch member, the latch cam engaged with the body cam when the first and second latch members are in the unlatching position; and the body cam comprises discrete body cam protrusions on opposite sides of the passage between the first and second ends thereof, the latch cam comprises discrete latch cams protruding from corresponding resilient arms on opposite sides of the second latch member.

7. The buckle of claim 6, a first engagement portion on an upper side of the first latch member and a second engagement portion on a lower side of the second latch member, the first and second engagement portions are engaged in the latching position and disengaged in the unlatching position.

8. The buckle of claim 7, the second engagement portion is disposed between the latch cam protrusions, the latch cam protrusions are engaged with the body cam protrusions and the second engagement portion of the second latch member is flexed away from the first engagement portion of the first latch member in the unlatching position.

9. The buckle of claim 8, the first engagement portion of the first latch member is positioned between the body cam protrusions when the latch cam protrusions are engaged with the body cam protrusions.

10. The buckle of claim 7, the first and second engagement portions of the first and second latch members include corresponding recesses across the first and second latch members.

11. A buckle comprising:

a body member having a passage with a body cam therein;

a first latch member having a first engagement portion;

a second latch member having a second engagement portion and a latch cam;

the first engagement portion of the first latch member disposed in the passage of the body member from one end thereof, the second engagement portion of the second latch member disposed in the passage of the body member from an opposite end thereof;

the first and second latch members movable in the passage to a latching configuration where the first engagement portion is engaged with the second engagement portion, and the first and second latch members being movable axially relative to the passage to an unlatching configuration where the latch cam is engaged with the body cam and the second engagement portion is flexed away from the first engagement portion.

12. A buckle comprising:

a body member having a passage with a body cam therein;

a first latch member having a first engagement portion;

a second latch member having a second engagement portion and a latch cam;

the first engagement portion of the first latch member disposed in the passage of the body member from one end thereof, the second engagement portion of the second latch member disposed in the passage of the body member from an opposite end thereof;

the first and second latch members movable in the passage to a latching configuration where the first engagement portion is engaged with the second engagement portion, the first and second latch members movable in the passage to an unlatching configuration where the latch cam is engaged with the body cam and the second engagement portion is flexed away from the first engagement portion;

the body cam comprises discrete body cam members protruding from opposite sides of the passage of the body member, and the latch cam comprises discrete latch cam members protruding from corresponding resilient arms on opposite sides of the second latch member.

13. The buckle of claim 12, the second engagement portion is coupled to the resilient arms of the second latch member between the discrete latch cam members, the first engagement portion of the first latch member is positioned between the discrete body cam members when the latch cam is engaged with the body cam.

14. A buckle comprising:

a body member having a passage with a body cam therein;

a first latch member having a first engagement portion;

a second latch member having a second engagement portion and a latch cam;

the first engagement portion of the first latch member disposed in the passage of the body member from one end thereof, the second engagement portion of the second latch member disposed in the passage of the body member from an opposite end thereof;

the first and second latch members movable in the passage to a latching configuration where the first engagement portion is engaged with the second engagement portion, the first and second latch members movable in the passage to an unlatching configuration where the latch cam is engaged with the body cam and the second engagement portion is flexed away from the first engagement portion; and the first engagement portion is disposed at least partially across an upper side of the first latch member, the second engagement portion is disposed at least partially across a lower side thereof, one of the first and second latch members has a slot and is coupled to the body member by a retention member extending from the body member through the slot.

15. A buckle comprising:

a body member having a passage with openings on opposite ends thereof;

a first latch member having a first engagement portion on one side thereof and a second latch member having a second engagement portion on a side thereof opposite the side of the first engagement portion on the first latch member;

a body cam disposed in the passage of the body member;

a latch cam disposed on the second latch member;

the first engagement portion of the first latch member disposed in the passage of the body member from the opening on one end thereof and the second engagement portion of the second latch member disposed in the passage of the body member from the opening on the opposite end thereof;

the first and second engagement portions engageable with each other when the first and second latch members are in a first position in the passage of the body member, and the latch cam engaged with the body cam and the second engagement portion disengaged from the first engagement portion when the first and second latch members are moved axially relative to the passage to a second position in the passage of the body member.

16. A buckle comprising:

a body member having a passage with openings on opposite ends thereof;

a first latch member having a first engagement portion on one side thereof and a second latch member having a second engagement portion on a side thereof opposite the side of the first engagement portion on the first latch member;

a body cam disposed in the passage of the body member;

a latch cam disposed on the second latch member;

the first engagement portion of the first latch member disposed in the passage of the body member from the opening on one end thereof and the second engagement portion of the second latch member disposed in the passage of the body member from the opening on the opposite end thereof;

the first and second engagement portions engageable with each other when the first and second latch members are in a first position in the passage of the body member, the latch cam engaged with the body cam and the second engagement portion disengaged from the first engagement portion when the first and second latch members are moved to a second position in the passage of the body member; and the body cam comprises discrete members protruding from opposite sides of the passage of the body member, the latch cam comprises discrete members protruding from corresponding resilient arms on opposite sides of the second latch member.

17. The buckle of claim 16, the second engagement portion of the second latch member disposed between the discrete latch cam members, the first engagement portion of the first latch member positioned between the discrete body cam members when the latch is engaged with the body cam.

18. A buckle comprising:

a body member having a passage with a body cam therein;

a first latch member having a first engagement portion;

a second latch member having a second engagement portion and a latch cam;

the first engagement portion of the first latch member disposed in the passage of the body member from one end thereof and the second engagement portion of the second latch member disposed in the passage of the body member from an opposite end thereof;

the first and second latch members movable between latching and unlatching positions in the passage of the body member;

in the latching position the first and second engagement portions are engaged with each other upon application of opposite forces to the first and second latch members, in the unlatched position the latch cam is engaged with the body cam and the first and second engagement portions are disengaged from each other upon application of opposite axial forces to the body member and the second latch member.

* * * * *